US005762222A

United States Patent [19]

Liu

[11] Patent Number: 5,762,222

[45] Date of Patent: Jun. 9, 1998

[54] COMPOSITE PACKING CONTAINER

[76] Inventor: Pang-Pao Liu, No. 108, Min Tsu Road, Shuang Lien, Sec. 2, Ping Cheng City, Taoyuan Hsien, Taiwan

[21] Appl. No.: 909,968

[22] Filed: Aug. 12, 1997

[51] Int. Cl.[6] ..... B65D 21/032

[52] U.S. Cl. ..... 220/1.5; 220/4.33; 220/441; 220/668; 220/622; 206/512; 206/600

[58] Field of Search ..... 220/1.5, 428, 4.33, 220/441, 668, 666, 622, 635, 646, 692; 217/65, 12 R, 13; 206/599, 600, 512, 511, 509

[56] References Cited

U.S. PATENT DOCUMENTS

| | | | |
|---|---|---|---|
| 2,578,644 | 12/1951 | Mantner | 220/668 |
| 4,166,569 | 9/1979 | Begnaud et al. | 220/441 |
| 4,625,880 | 12/1986 | Pym | 220/668 |
| 5,036,979 | 8/1991 | Selz | 206/512 |
| 5,205,428 | 4/1993 | Yurgevich et al. | 220/1.5 |
| 5,279,436 | 1/1994 | Elliott et al. | 220/4.33 |
| 5,429,259 | 7/1995 | Robin | 220/4.33 |
| 5,531,326 | 7/1996 | Hummel et al. | 206/512 |

*Primary Examiner*—Stephen J. Castellano

*Attorney, Agent, or Firm*—Morton J. Rosenberg; David I. Klein; Jun Y. Lee

[57] ABSTRACT

The present invention relates to a composite packing container which generally comprises a bottom bracket, a front, rear, left and right side panels which jointly define a box unit, and a cover which can be enveloped onto the box unit. Characterized in that the front and rear side panels have an identical configuration and the side panel is configured by a multi-layer corrugated paper board having mounted with a L-shape iron plate by a locking screw at both ends. The upper and bottom sides of the paper board are enclosed with an U-shape bar which also covers to the L-shape iron plate. The left and right side panels are configured with an identical configuration and similar to the front and rear side panels in general. The left and right side panels are provided with a 7-shape iron plate which is different to the front and rear side panels. The 7-shape iron plate is designed and sized such that it can be readily received and retained within a space defined by the L-shape iron plate of the front and rear side panels. A locking screw is applied to lock them up.

2 Claims, 12 Drawing Sheets

COMPOSITE PACKING CONTAINER

FIELD OF THE INVENTION

The present invention relates to a packing container, more particularly, to a composite packing container which is configured with metal truss and corrugated paper wall. By this arrangement, this composite packing container features a light-weight and enhanced rigidity for packing articles therein. The composite container can be also readily disassembled for recyclable usage.

DESCRIPTION OF PRIOR ART

The conventional packing containers can be categorized into the iron box, wooden box and paper-board box. The iron box is made from iron bar and sheet by welding. It features a tough and endurable service life. However, it is too heavy to transportation, i.e. increase the freight. Furthermore, when the articles loaded therein is unpacked, it is difficult to handle this iron box because it is difficult to dissemble. The wooden container is assembled by a plurality of wooden plates and rod. When the wooden plates are firmly connected from each other, it is difficult to separate them from each other. If the user hopes to separate the wooden box forcibly, the overall integrity will be damaged. As environment protection has become a trend now and future, the resource of wooden plates become more and more rare. The cost of wooden plate will increase sooner or later. Even the paper board box may contain the articles therein, it has a poor rigidity which can not sustain heavy article. Consequently, the service range of the paper board box is limited.

From the above discussion, it can be readily appreciated that all of these existing packing container have its inherited short backs. However, each of those containers is also featured with a certain advantage. If the features of those existing containers can be integrally assembled, then a practical and useful container can be attained.

SUMMARY OF THE INVENTION

It is the objective of this invention to provide a composite packing container by which the problems encountered by each and every packing boxes can be completely solved.

It order to achieve the objective set forth, the composite packing box made according to the present invention generally comprises a configuring truss which is preferable made from iron. A corrugated paper board is further applied to serve as the packing wall of the composite packing container. By this arrangement, a rigid but light packing container is attained. The corrugated paper-board can be readily disassembled for recyclable usage.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
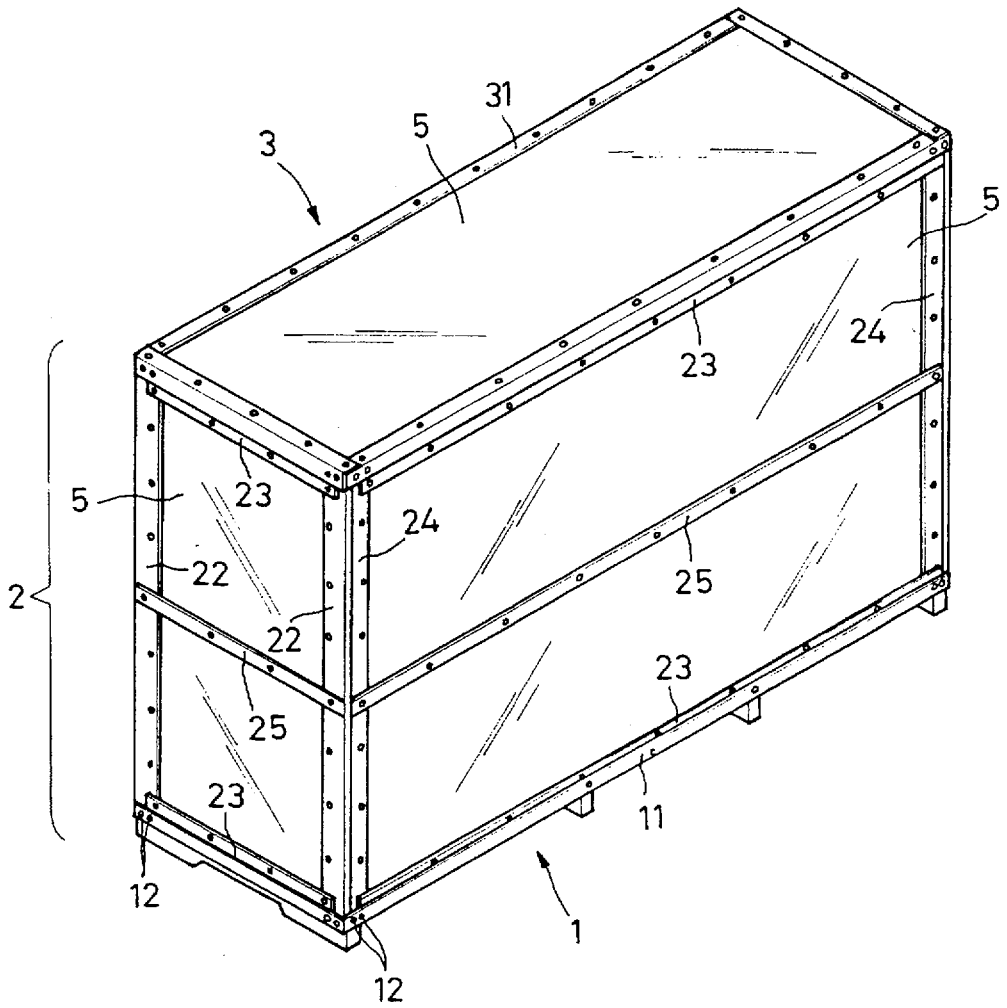
FIG. 1 is a perspective view of the composite packing container made according to the present invention.

Referring to FIGS. 1 to 5, the composite packing container generally comprises a bottom bracket 1 which is configured a frame 11 having a plurality of iron rods alternatively and fixedly disposed therein. The frame 11 is provided with a plurality of threaded holes 12.

A box unit 2 is configured by a front, rear, left and right panels 2*a*, 2*b*, 2*c* and 2*d*. The box unit 2 can be received and retained within the frame 11 of the bottom bracket 1. Each of the panels 2*a*, 2*b*, 2*c* and 2*d* is provided with a threaded hole 21 corresponding and aligned to the threaded hole 12 of the frame 11.

A cover 3 is made from iron and is provided with a frame portion 31 which can be enveloped onto the top portion of the box unit 2. A locking screw 4 can be used to fix the cover 3 onto the box unit 2. At least four dowel plates 32 are disposed at four corners of the frame 31 of the cover 3 respectively. By this arrangement, the bottom bracket 1 of another composite packing box can be suitably stacked thereon.

Characterized in that the front and rear side panels 2*a* and 2*b* have an identical configuration. The side panel 2*a* (or 2*b*) is configured by a multi-layer corrugated paper board 5 having mounted with a L-shape iron plate 22 with locking screw 4. The upper and bottom sides of the paper board 5 is enclosed with an U-shape bar 23 which also covers to the L-shape iron plate 22.

Furthermore, the left and right side panels 2*c* and 2*d* have an identical configuration. The left and right side panels 2*c* and 2*d* are identical to the front and rear side panels 2*a* and 2*b* in general. However, the left and right side panels 2*c* and 2*d* are provided with a 7-shape iron plate 24 which is different to the front and rear side panels 2*a* and 2*b*. The 7-shape iron plate 24 is designed and sized that it can be readily received and retained within the L-shape iron plate 22 of the front and rear side panels 2*a* and 2*b*. A locking screw 4 can be applied to lock them up.

The frame 31 of the cover 3 is also fixedly disposed with a corrugated paper board 5 by means of locking screw 4. Finally, a cover is configured.

Each of the corrugated paper board 5, the L-shape iron plate 22 of the box unit 2, the U-shape iron plate 23, the 7-shape iron plate 24 and the frame 31 of the cover 3 is provided with pressing plate 6 in the position where the locking screw 4 is to locked. Accordingly, when the locking screw 4 is locked, the overall pressing area of the locking screw 4 is enlarged by the provision of the pressing plate 6.

By assembling those above described components, a composite packing container is configured. The composite packing container features a tough truss which is made from iron bars. However, the enclosing walls of the composite packing box are made from corrugated boards which are light and tough and is recyclable.

Figure 2:
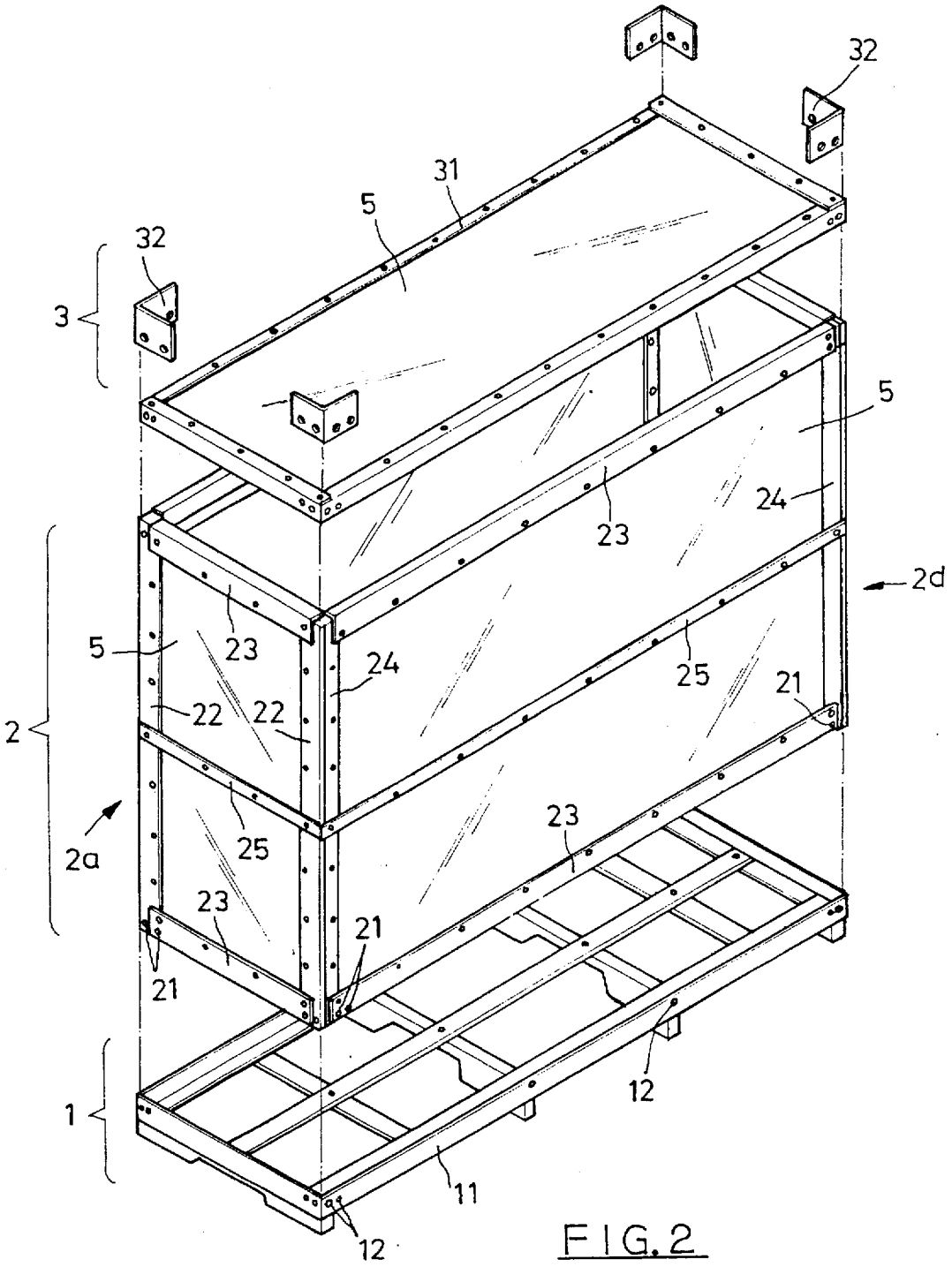
FIG. 2 is an exploded perspective view of the composite packing container made according to the present invention.
Figure 3:
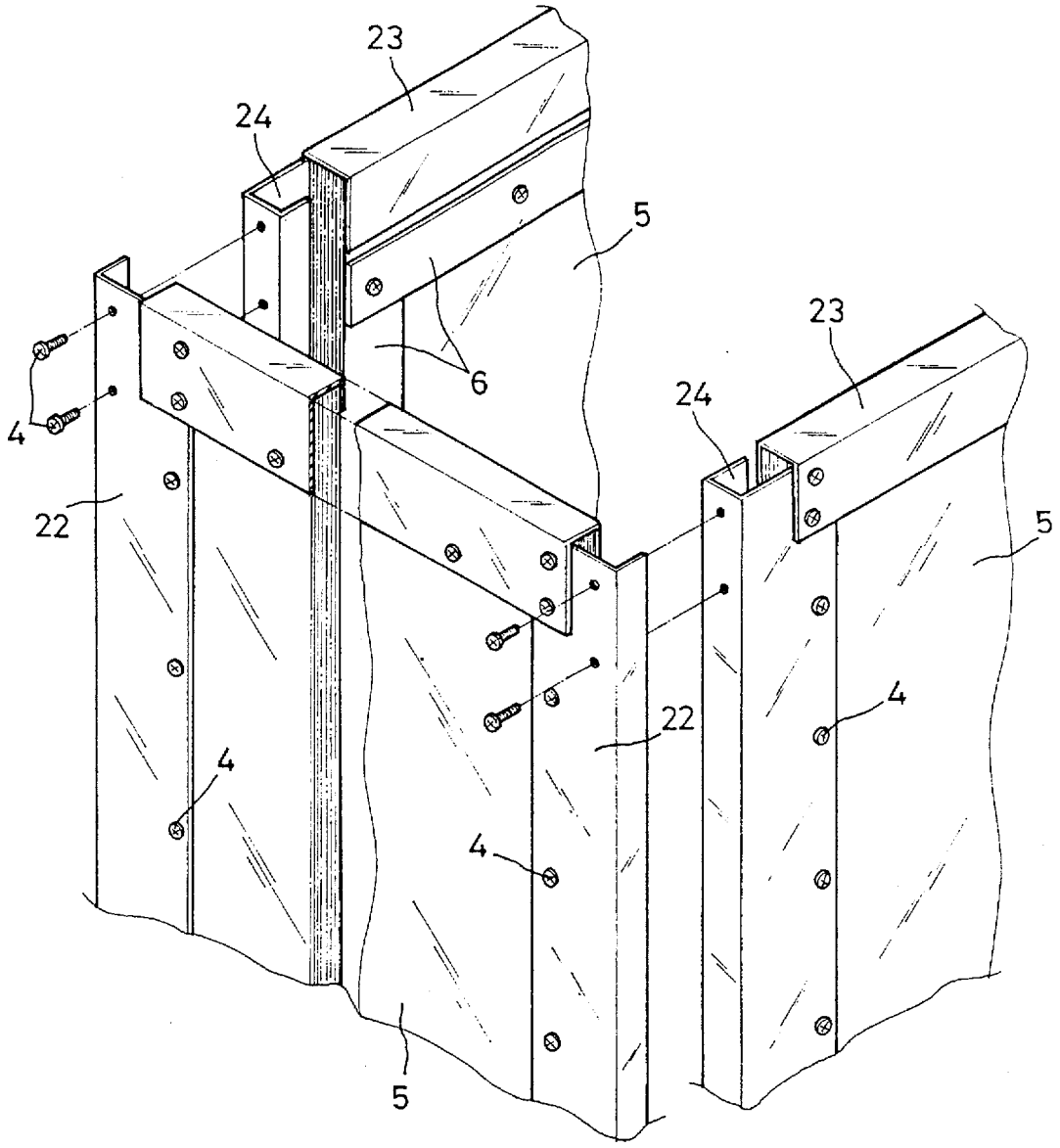
FIG. 3 is a schematic illustration showing the connection between the side panel and the main panels.
Figure 4:
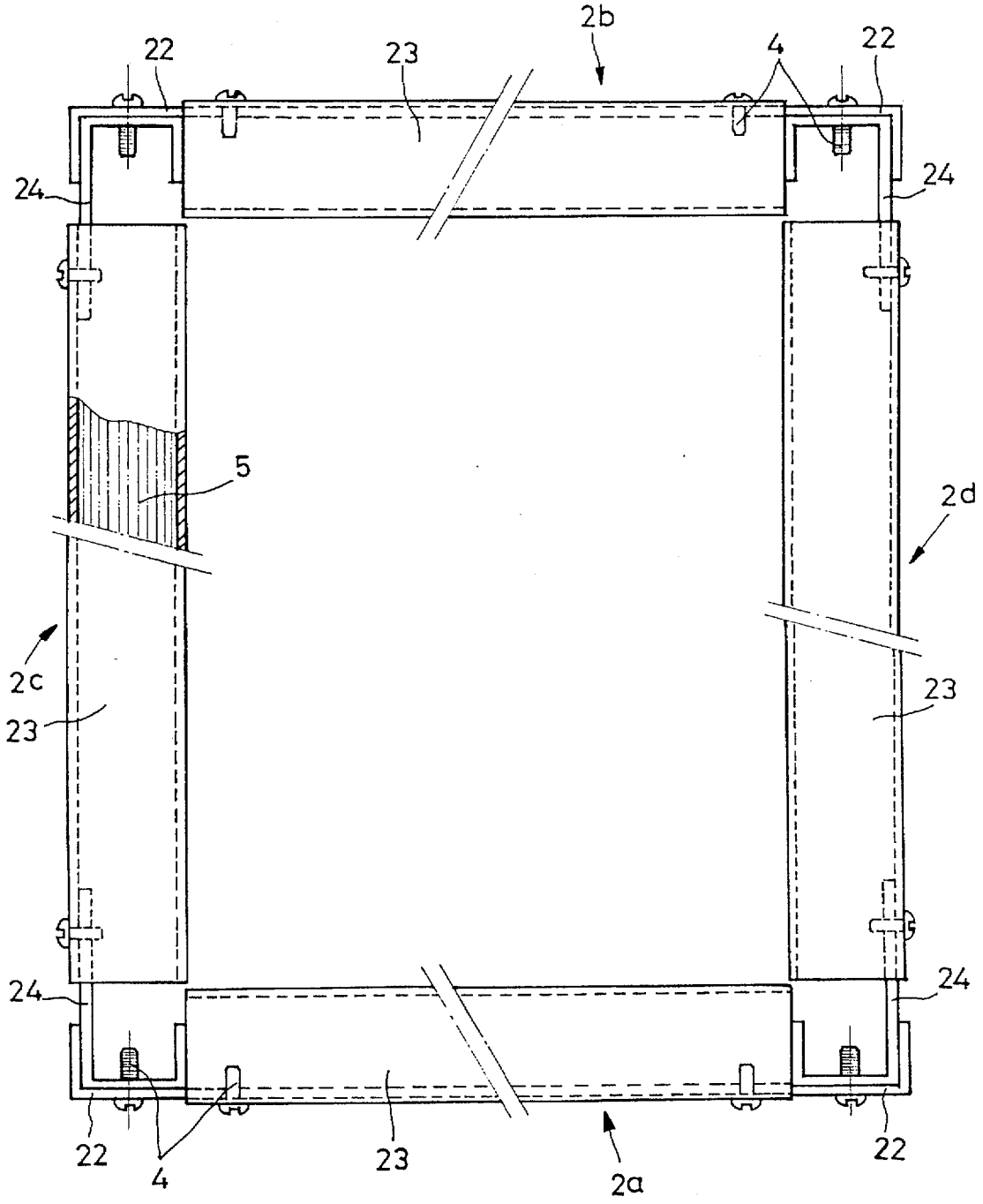
FIG. 4 is a top plan view showing the connection between the side panel and the main panels.
Figure 5:
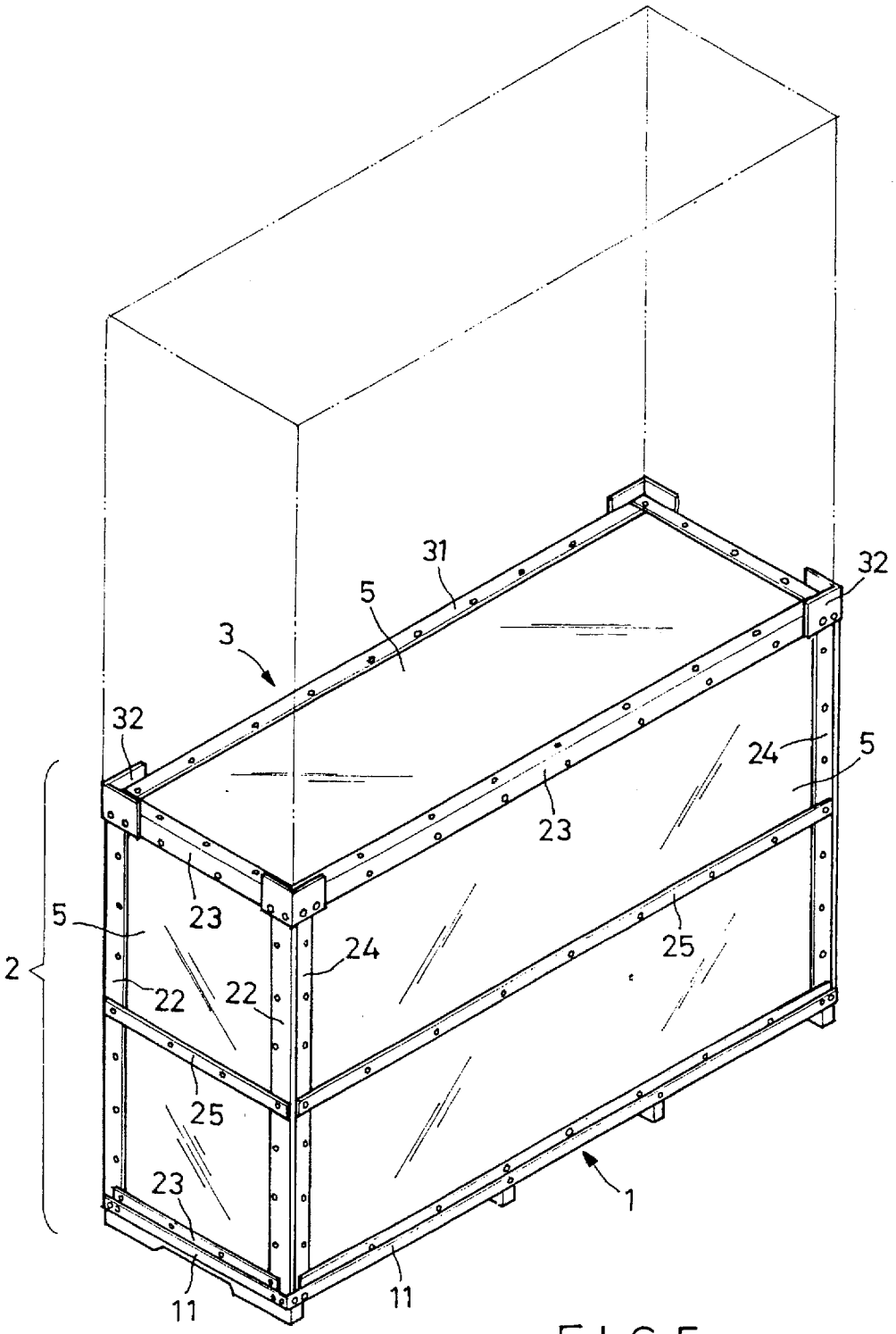
FIG. 5 is a schematic illustration showing the composite packing container is stacked together.
Figure 6:
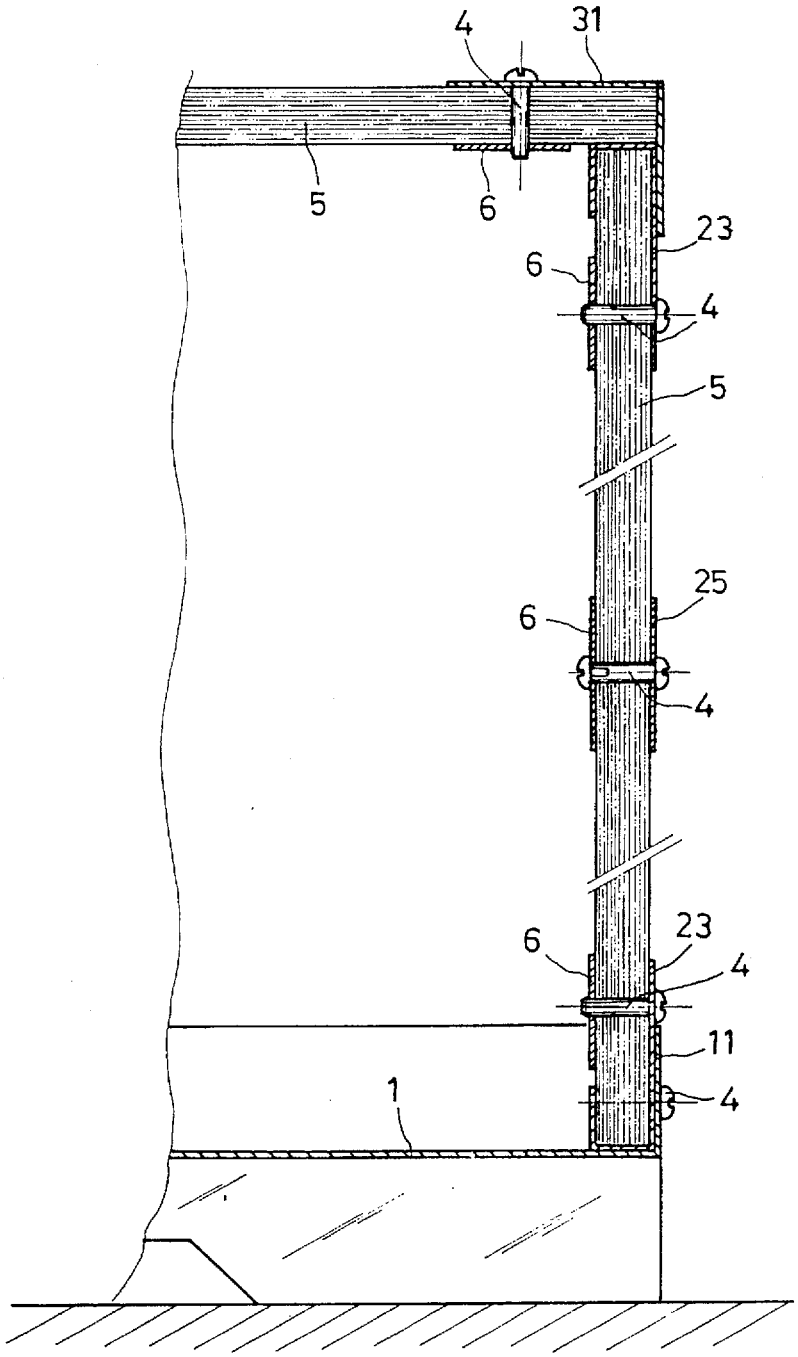
FIG. 6 is a cross sectional view of the side panel which is equipped with a traverse bar.
Figure 7:
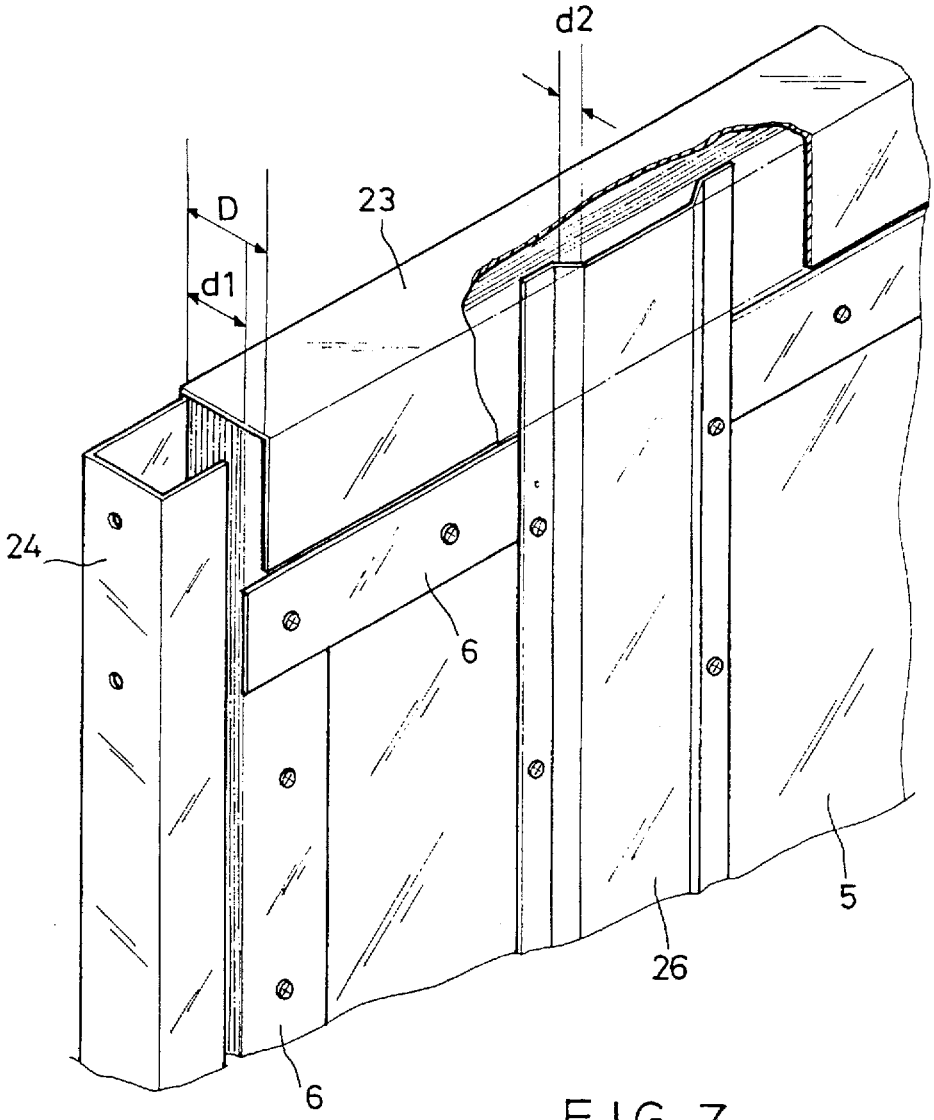
FIG. 7 is a schematic illustration showing the a shape-bar is attached to the side panel to cooperate the thickness change of the paper board.

Referring to FIGS. 1, 2 and 6, each of the side panels 2*a*, 2*b*, 2*c* and 2*d* of the box unit 2 is provided with a traverse bar 25 which is strong enough to resist any side impact to the corrugated board 5.

On the other hand, when the thickness of the corrugated board 5 is modified or reduced to d1, another U-shape iron bar 26 is longitudinally disposed between the upper and lower U-shape iron plates 23, wherein D=d1+d2.

Figure 8:
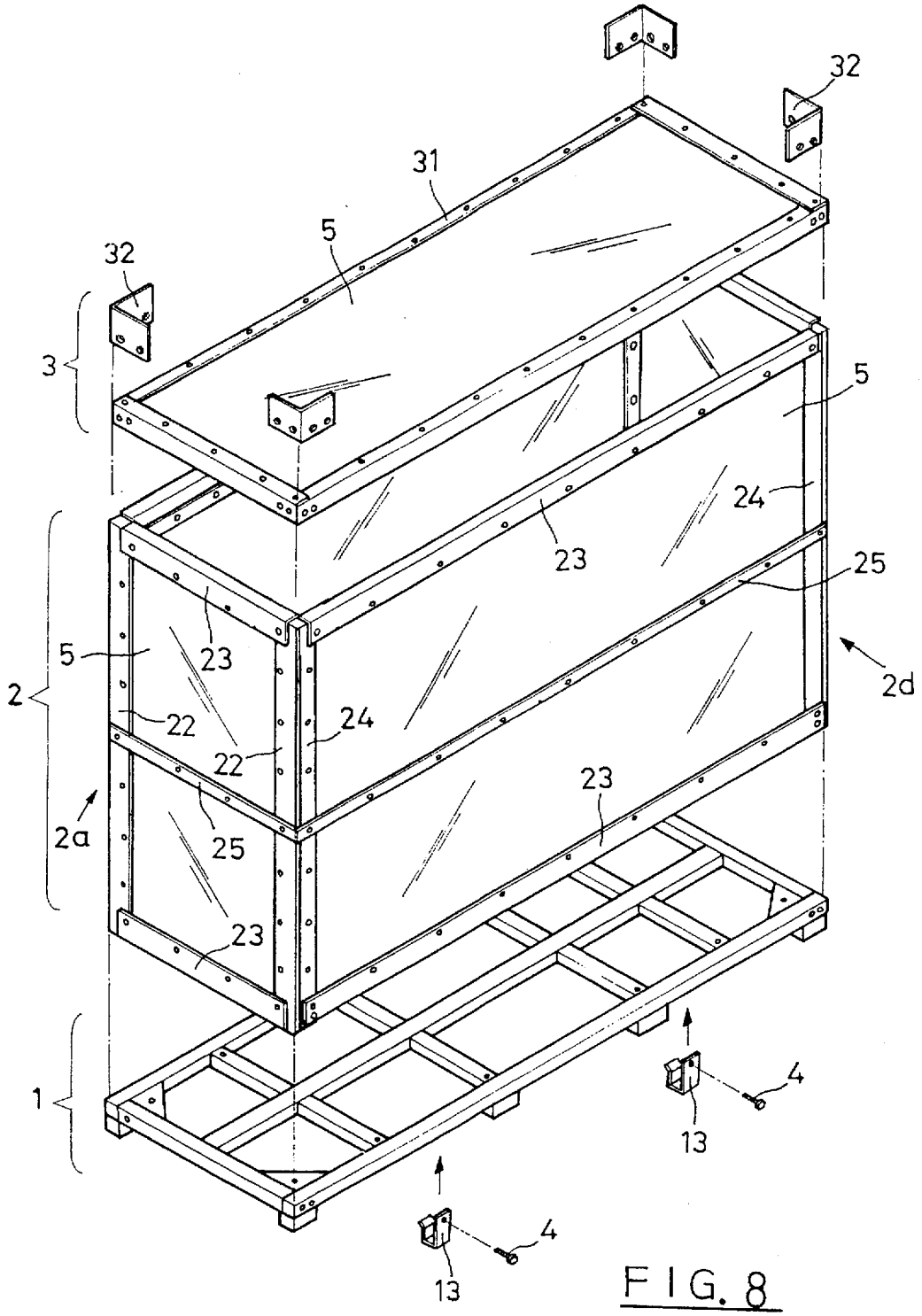
FIG. 8 is a perspective view showing the bottom bracket and the box unit thereof.
Figure 9:
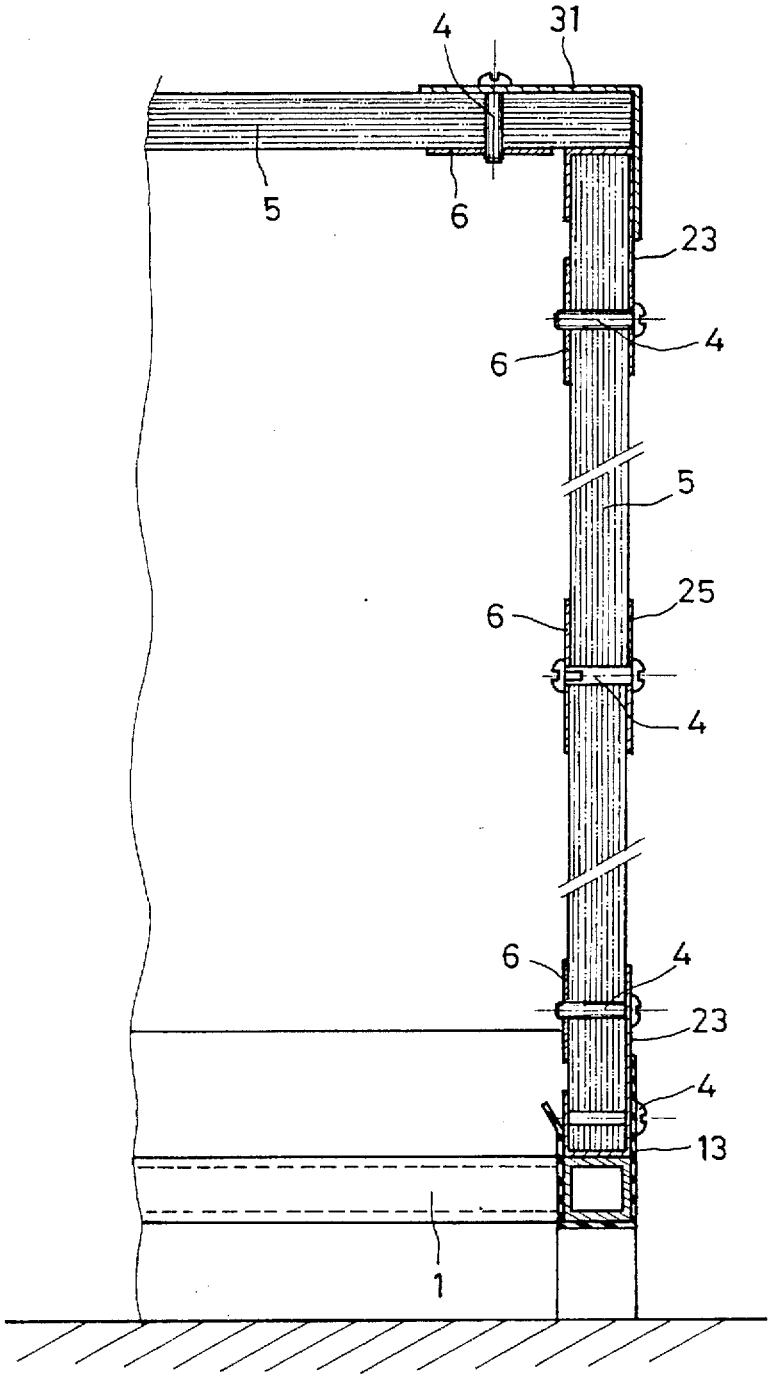
FIG. 9 is cross sectional view of the bottom bracket and the box unit of another feasible embodiment.

Referring to FIGS. 8 and 9, the bottom bracket 1 can be directly attached with a U-shape fixing element 13 by which the box unit 2 can the bottom bracket 1 can be integrally assembled by the locking screws 4 which are applied at side of the fixing element 13.

Figures 10, 11:
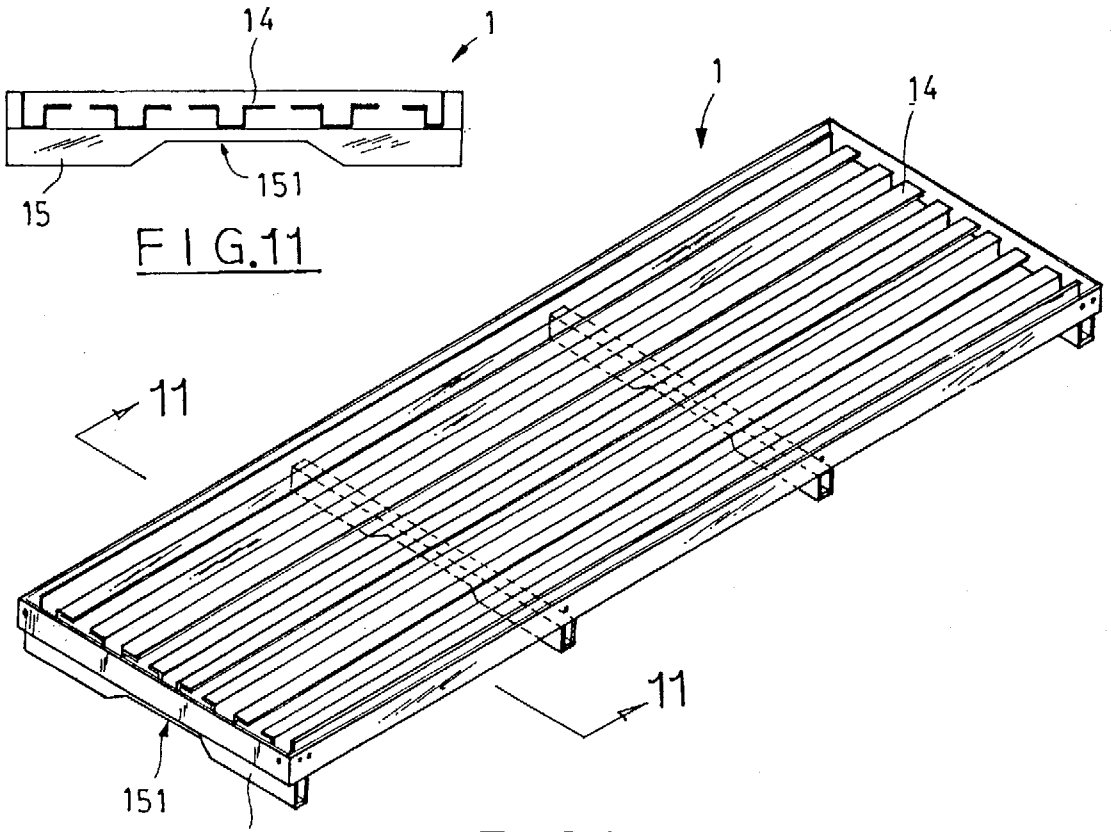
FIG. 10 is a perspective view of the bottom bracket of another feasible embodiment.
FIG. 11 is a cross sectional view taken from line 11—11 in FIG. 10.
Figure 12:
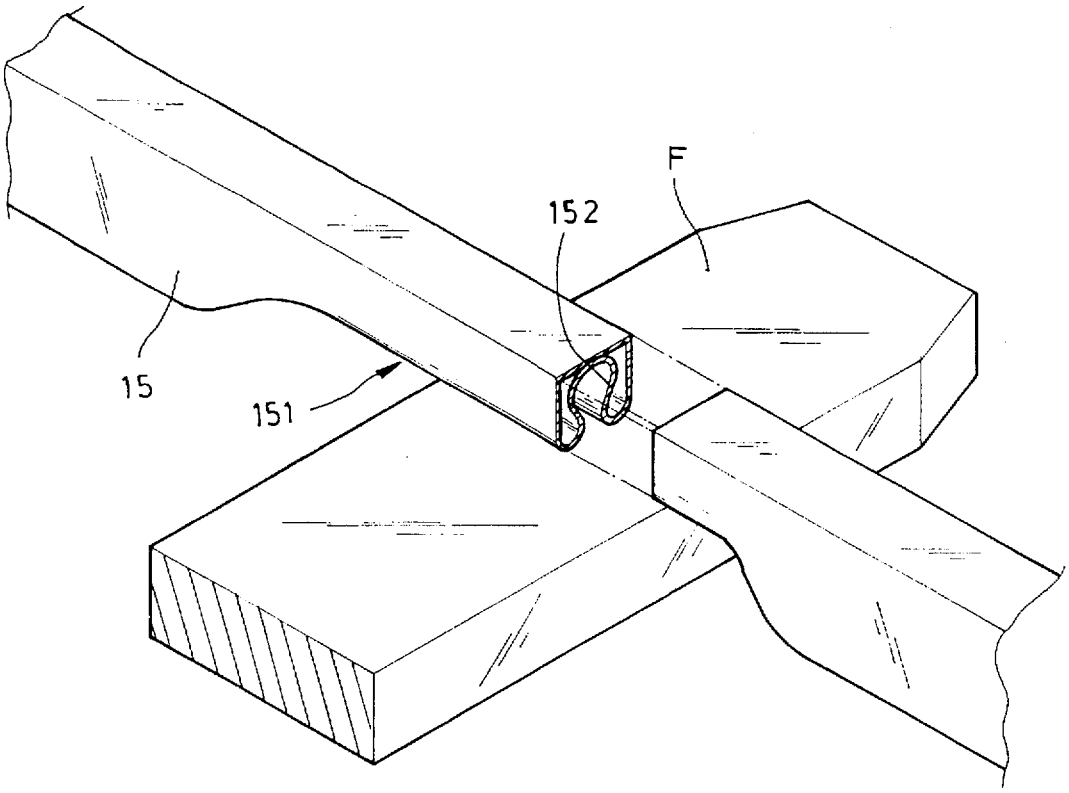
FIG. 12 is a schematic illustration of a supporting bar of the bottom bracket shown in FIG. 10.

As shown in FIGS. 10 to 12, the inner configuration of the bottom bracket 1 can be specially arranged according to actual requirements. For example, a plurality of U-shape iron plate 14 can be applied and which may increase the rigidity and provide convenience in assembling work. The supporting bar 15 which is a short rectangular bar on the bottom of the bottom bracket 1 can be pressed to form a groove 151 thereof. The excess material on the groove 151 can be formed with a continuous contour 12 inwardly and continuously. As a result, the supporting bar 15 may strengthen the overall rigidity of the bottom bracket 1 and it can be readily manufactured.

Figure 13:
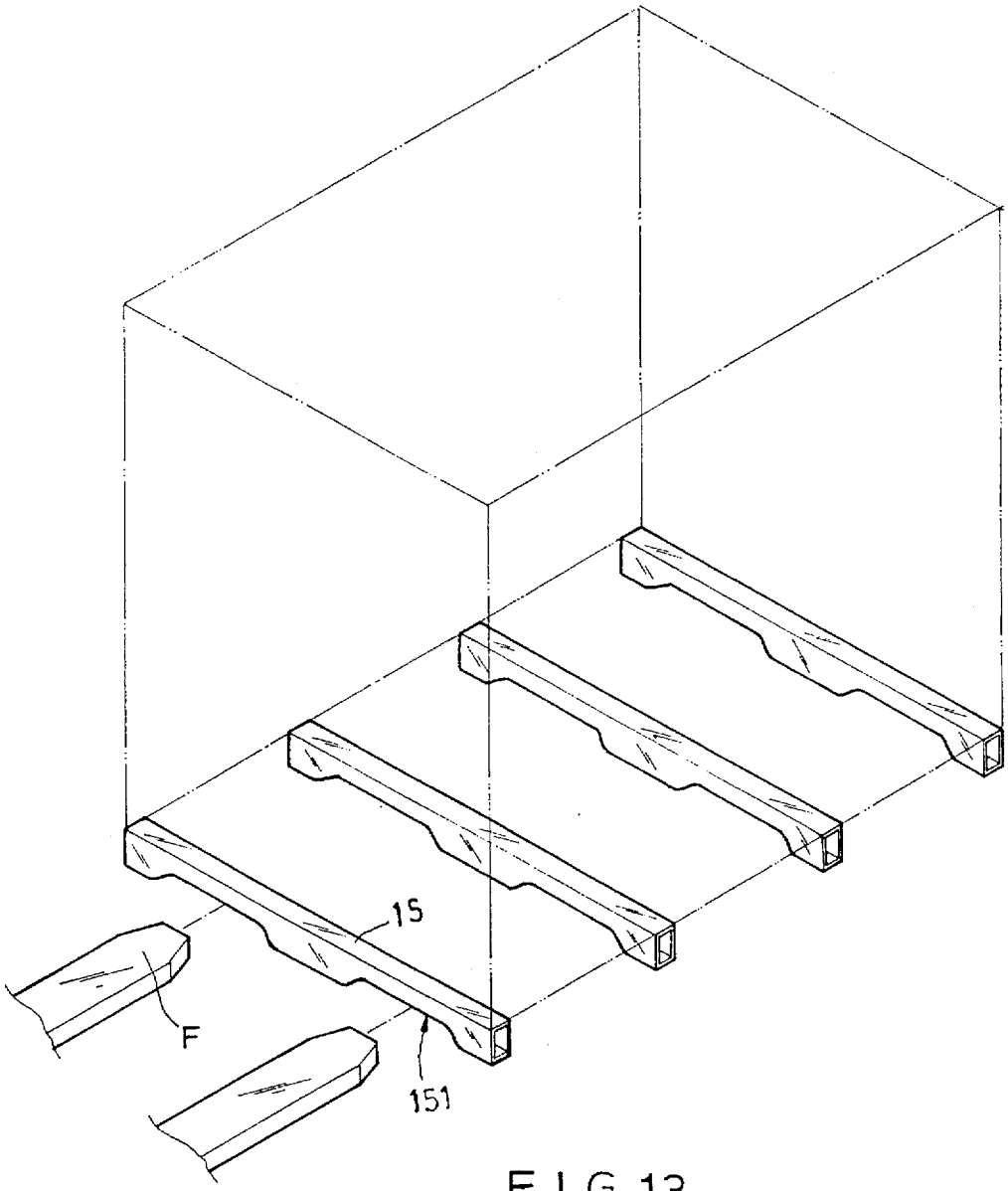
FIG. 13 is a schematic illustration of the supporting bar.

Besides, the width of the groove 151 is large enough such that the fork F of a lifter can be inserted and lift the bottom bracket 1. Furthermore, the overall rigidity can be readily increased by the reinforced groove 151. As a result, the composite packing container can be readily moved by the lifter without any deformation, as clearly shown in FIG. 13.

The present invention has been detailedly described is above, the functional features will be described in the following texts.

In the composite packing container, the supporting truss is made from iron while the enclosing wall is configured by corrugated paper board. As a result, the composite packing container may substain a heavy load which the overall weight is lowered. The lowered weight may really benefit the stacking or delivering the composite packing container. On the other hand, the connection between those components are attained by locking screw and threaded hole, it can be readily assembled as well as dissembled. In light of this, the corrugated paper board and the truss can be recycled and reused.

By the removably attaching of the corrugated board to the truss, this may really benefit the unloading of the heavy cargo. In the past, those heavy articles, for example the motorcycle, shall be lifted and removed from the container by overhead crane because the container is too tough to destroy. By the provision of the present invention, the side panels can be disassembled one by one and finally the motorcycle can be move out. As a result, the unloading procedures are simplified.

From the forgoing description, it can be readily appreciated that the composite packing container features an enhanced rigidity as well as high protecting capability benefited from the corrugated paper board. The composite packing container is strong as the iron and wooden container while it is more lighter. All of the configuring components can be readily dissembled for reuse. In case some components is broken, the user only need to replace the damaged one. As environmental protection has become a trend, this is readily an excellent packing container which meet the philosophy of utility as well as environmental protection.

I claim:

1. A composite packing container generally comprising:

a bottom bracket which is configured a frame having a plurality of iron rods alternatively and fixedly disposed therein, said frame being provided with a plurality of threaded holes;

a box unit being configured by a front, rear, left and right panels and which can be received and retained within said frame of said bottom bracket, each of said panels being provided with a threaded hole corresponding and aligned to said threaded hole of said frame;

a cover being made from iron and being provided with a frame portion which can be enveloped onto the top portion of said box unit, a locking screw being used to fix said cover onto said box unit, at least four dowel plates being disposed at four corners of said frame of said cover respectively for stacking a plurality of container thereon;

characterized in that said front and rear side panels have an identical configuration and said side panel being configured by a multi-layer corrugated paper board having mounted with a L-shape iron plate by a locking screw at both ends, the upper and bottom sides of said paper board being enclosed with an U-shape bar which also covers to said L-shape iron plate, said left and right side panels being configured with an identical configuration and being similar to said front and rear side panels in general, said left and right side panels being provided with a 7-shape iron plate which is different to said front and rear side panels, said 7-shape iron plate is designed and sized such that it can be readily received and retained within a space defined by said L-shape iron plate of said front and rear side panels, a locking screw being applied to lock them up;

said frame of said cover being also fixedly disposed with a corrugated paper board by means of a locking screw, each of said corrugated paper board, said L-shape iron plate of said box unit, said U-shape iron plate, said 7-shape iron plate and said frame of said cover being provided with pressing plate in the position where said locking screw is to locked such that when the locking screw is locked, the overall pressing area of said locking screw is enlarged by the provision of said pressing plate;

wherein by the configuration of the above described components, i.e. having an iron truss and corrugated paper board walls, a light but tough composite packing container is attained and which can be disassembled for repetitively use.

2. A composite packing container as recited in claim 1, wherein the inner configuration of said bottom bracket can be specially arranged, the supporting bar which is a short rectangular bar on the bottom of said bottom bracket can be pressed to form a groove thereof, the excess material on said groove can be formed with a continuous contour inwardly and continuously.

* * * * *